United States Patent [19]

Mandusky

[11] 4,082,256

[45] Apr. 4, 1978

[54] SEAT ASSEMBLY

[75] Inventor: Jack C. Mandusky, Lexington, Ky.

[73] Assignee: Hoover Ball and Bearing Company, Saline, Mich.

[21] Appl. No.: 735,171

[22] Filed: Oct. 26, 1976

[51] Int. Cl.[2] ..... A47C 23/00

[52] U.S. Cl. ..... 267/81; 5/351; 297/451

[58] Field of Search ..... 267/8.3, 81, 90, 102, 267/107, 109; 297/451; 5/351

[56] References Cited

U.S. PATENT DOCUMENTS

| | | | |
|---|---|---|---|
| 2,897,879 | 8/1959 | Brown et al. | 267/81 |
| 3,087,718 | 4/1963 | Brown | 267/81 |
| 3,800,343 | 4/1974 | Frachte | 297/452 |

*Primary Examiner*—James B. Marbert

*Attorney, Agent, or Firm*—Olsen and Stephenson

[57] ABSTRACT

A seat back structure is provided that includes a frame and spring assembly having formed wire spring members supported on the frame, and a resilient pad is mounted over the formed wire spring members and has recesses in its inner surfaces which constrain movements of the wire spring members longitudinally and transversely relative to one another.

6 Claims, 3 Drawing Figures

10
12
14
16
18
20
22
24
26
28
30
32
34
36
38
40
42
44
46
48
50
2
3

SEAT ASSEMBLY

BACKGROUND OF THE INVENTION

The present invention relates to seat structures, and particularly to a seat back for use in automobiles.

In the construction of seat backs, it is conventional practice to provide frame and spring assemblies which have a plurality of formed wire spring members mounted on a seat back frame, and the formed wire spring members are retained against shifting relative to one another by interconnecting wires which are secured to the formed wire spring members by clips or other suitable attachment means. Padding is then applied over the interconnected springs.

Substantial efforts are being made in the automobile industry to reduce the weights of automobiles while improving their quality. These efforts are prompted by needs for improved fuel economy and lower manufacturing costs per vehicle. In addition, the automobile seating industry, while striving to meet these needs, is also seeking to develop seat structures for vehicles which provide improved riding and sound characteristics, and the like.

SUMMARY OF THE INVENTION

The present invention has overcome the inadequacies of the prior art and provides a seat structure which is constructed and arranged so that the interconnecting wires and associated clips that have been used in the prior art for interconnecting the formed wire spring members can be eliminated. Elimination of these interconnecting wires and associated clips will reduce to a limited extend the weights of the seat structures for the automobiles and also will reduce to a limited extent the cost of manufacturing the seat structures, both from the material and labor standpoints. Further, squeaking or other undesirable noises, which, on some occasions are caused by relative movement of the clips or interconnecting wires with respect to the formed wire spring members are thereby eliminated.

According to one form of the present invention, a seat structure is provided which has a frame and spring assembly comprising a frame and a plurality of wire spring members supported at their ends on the frame in generally parallel spaced relationship, the intermediate portions of these wire spring members projecting in a common direction from the frame to define a load bearing spring surface. A pad is supported on and covers the load bearing spring surface. The pad has an inner wall with recesses therein into which the intermediate portions of the wire springs are encased so as to be constrained from shifting out of their normal positions with respect to one another. Thus, the pad functions to provide comfort and also to act as the interconnecting means between the wire spring members, maintaining the wire spring members in their proper relative positions with respect to one another.

Thus, it is the principal object of the present invention to provide an improved seat construction which is primarily adapted for use in the automobile industry, but which can be utilized in any type of seating construction where frame and spring assemblies are provided and padding, such as foamed elastomeric pads is used to cover the wire spring members.

Other objects of this invention will appear in the following description and appended claims, reference being had to the accompanying drawings forming a part of this specification wherein like reference characters designate corresponding parts in several views.

DESCRIPTION OF THE PREFERRED EMBODIMENT

Figures 1, 2, 3:
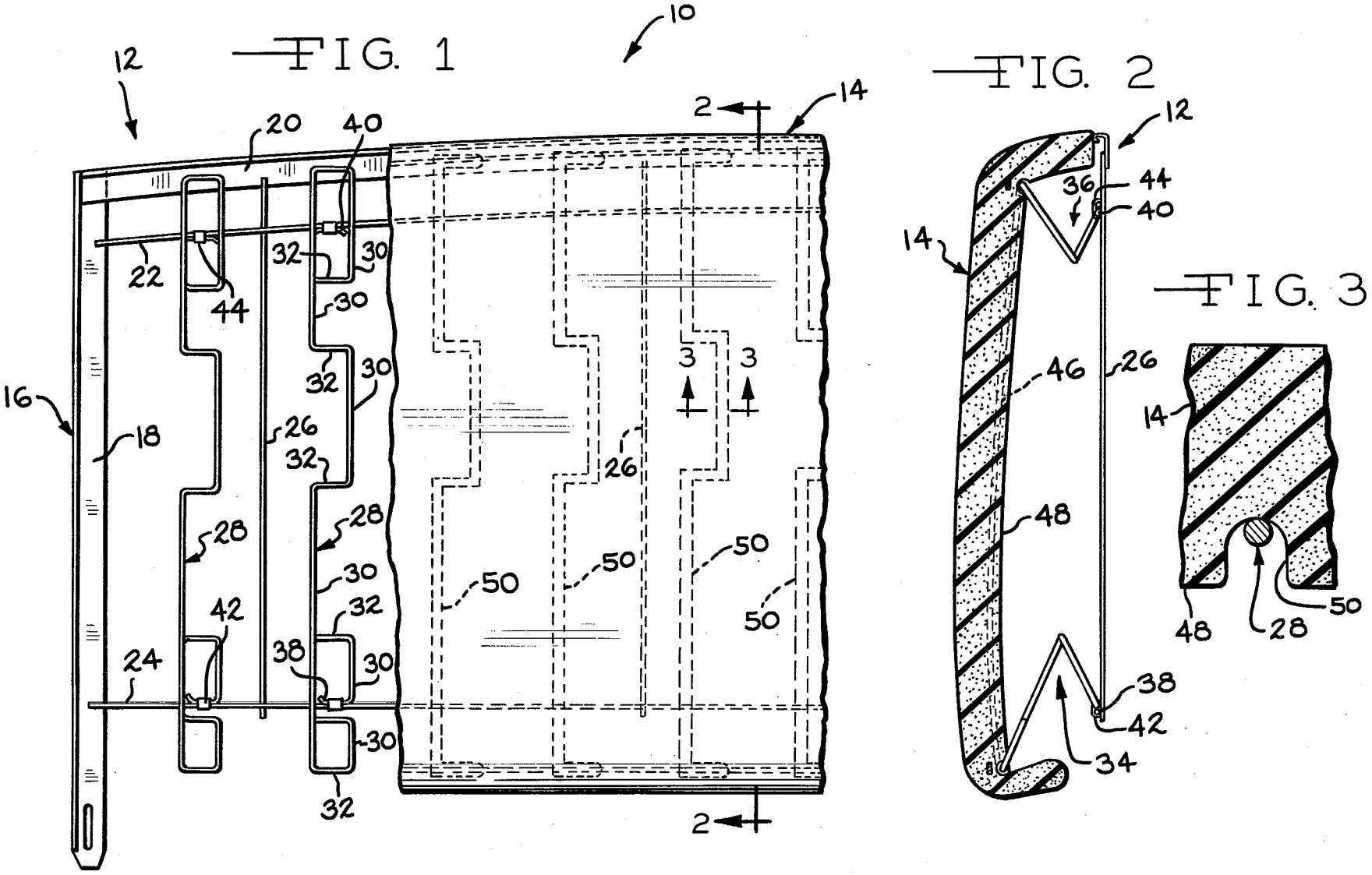
FIG. 1 is a fragmentary front elevational view of a seat back construction embodying the present invention, with portions of the pad of the seat back removed to illustrate the construction of the frame and spring assembly.
FIG. 2 is a sectional view taken on the lines 2—2 of FIG. 1.
FIG. 3 is an enlarged fragmentary sectional view taken on the lines 3—3 of FIG. 1.

Before explaining the present invention in detail, it is to be understood that the invention is not limited in its application to the details of construction and arrangement of parts illustrated in the accompanying drawing, since the invention is capable of other embodiments and of being practiced or carried out in various ways. Also, it is to be understood that the phraseology or terminology employed herein is for the purpose of description and not of limitation.

Referring now to the drawing, the invention will be described in greater detail. The seat back structure 10 includes a frame and spring assembly 12 on which is mounted a pad 14 which is formed from any suitable foamed elastomer.

The frame and spring assembly 12 includes the frame 16 which includes spaced end frame member 18, only one of which is shown, and transverse frame member 20 connected to the upper ends of the end frame members 18. Also spanning and being connected to the end frame members 18 are the straight transverse members or wires 22 and 24. Similiarly spanning and extending in a vertical direction and being connected to the transverse frame member 20 and to the transverse members or wires 22 and 24 are a plurality of wires 26. The frame assembly components 16, 18, 20, 22, 24 and 26 are suitably secured together, such as by welding.

Comprising components of the frame and spring assembly 12 are the plurality of wire spring members 28, each of which is a one-piece formed wire element having longitudinal segments 30 and transverse torsion bar segments 32. The spring wire members 28 are formed in the known manner to provide fish-mouth constructions 34 and 36 adjacent to their terminal ends 38 and 40. The terminal ends 38 and 40 are mounted on the frame 16 by the clips 42 and 44 which fasten these ends to the transverse members 22 and 24. As can be seen best in FIG. 2, the intermediate portions 46 of the wire spring members 28 project in a direction away from the terminal ends 38 and 40 and beyond the fish-mouth constructions 34 and 36 to define a load bearing spring surface for the seat structure 10. Other than the clips 42 and 44 which secure the individual wire spring members 28 to the frame assembly 16, no interconnecting wire elements extend between the wire spring members 28 to secure them against undesirable shifting relative to one another.

In accordance with the present invention, the pad 14 has been constructed and arranged so that it performs the dual function of providing the necessary padding over the load bearing spring surface and to interconnect the spring members 28 so that undesirable relative shifting between these members is avoided. The pad 14 performs this function in a manner to eliminate completely squeaking or other undesirable noises that otherwise might be caused by metal-to-metal contact between interconnecting members or clips and the wire spring members. This function is performed by the pad 14 without increasing the weight of the pad when compared with pads that exist in the prior art.

To accomplish the desired functions, the pad 44 is molded according to known procedures so that the inner wall 48 thereof has a plurality of recesses of channel like structure 50 corresponding in number and configuration to the load bearing spring surface portion of each of the wire spring members 28. These recesses 50 are defined by the skin of the foamed elastomer and they encase longitudinal and transverse torsion bar segments of the wire spring members 28 so as to constrain the wire spring members from undesirable movement relative to one another. The elastic properties of the foamed elastomer also allows a desirable amount of flexibility of the load bearing spring surface to assure optimum comfort.

Thus, a seat structure is provided which is lighter in weight than those of the prior art and is quieter in operation. Further, the seat structure can be produced at lower cost because of the elimination of the interconnecting wires and clips conventionally used heretofor for interconnecting the wire spring members 28. The present invention is particularly adapted for use in conjunction with seat backs of motor vehicles, but it will be recognized that it can also be utilized in other seat constructions.

It is claimed:

1. In a seat structure, a frame and spring assembly comprising a frame, and a plurality of wire spring members supported at their ends on the frame in generally parallel spaced relationship, the intermediate portions of said wire spring members projecting in a common direction from said frame to define a load bearing spring surface for said seat structure, and a pad supported on and covering said load bearing spring surface, said pad having an inner wall with recesses therein into which said intermediate portions are encased so as to be constrained from shifting with respect to one another, said pad being a foamed elastomer and having an external skin, said recesses being defined by said skin as channel-like structures.

2. In a seat structure, the combination that is defined in claim 1, wherein said frame and spring assembly includes spaced end frame members, and a pair of straight transverse members spanning the space between and secured at their ends to said end frame members, said plurality of wire spring members being supported at their ends on the frame by being connected to said pair of straight transverse members.

3. In a seat structure, the combination that is defined in claim 2, wherein said pair of straight transverse members and said pad are the only interconnecting members between said plurality of wire spring members.

4. In a seat structure, the combination that is defined in claim 3, wherein said frame and spring assembly is adapted for a seat back and has a transverse frame member connected to the upper ends of said end frame members.

5. In a seat structure, the combination that is defined in claim 1, wherein each of said wire spring members is a one-piece wire element having longitudinal segments and transverse torsion bar segments, each wire spring member having a metal-to-metal connection with other components of the seat structure only at its terminal ends where it is supported on said frame.

6. In a seat structure, the combination that is defined in claim 5, wherein each of said wire spring members defines a fish-mouth adjacent to each terminal end, the segments of the wire spring members between their fish-mouthes defining the load bearing spring surface, and each wire spring member has at least one transverse torsion bar segment and at least one longitudinal segment in said load bearing spring surface, and said pad has recesses encasing the transverse and longitudinal segments so that said pad constrains each wire spring member against both sidewise and longitudinal movement relative to the other wire spring members.

* * * * *